US008300839B2

(12) United States Patent
Ishibashi et al.

(10) Patent No.: US 8,300,839 B2
(45) Date of Patent: Oct. 30, 2012

(54) SOUND EMISSION AND COLLECTION APPARATUS AND CONTROL METHOD OF SOUND EMISSION AND COLLECTION APPARATUS

(75) Inventors: Toshiaki Ishibashi, Fukuroi (JP); Ryo Tanaka, Hamamatsu (JP); Satoshi Ukai, Hamamatsu (JP)

(73) Assignee: Yamaha Corporation (JP)

( * ) Notice: Subject to any disclaimer, the term of this patent is extended or adjusted under 35 U.S.C. 154(b) by 903 days.

(21) Appl. No.: 12/302,653

(22) PCT Filed: May 24, 2007

(86) PCT No.: PCT/JP2007/060639

§ 371 (c)(1),
(2), (4) Date: Nov. 26, 2008

(87) PCT Pub. No.: WO2007/138985

PCT Pub. Date: Dec. 6, 2007

(65) Prior Publication Data

US 2009/0180633 A1 Jul. 16, 2009

(30) Foreign Application Priority Data

May 26, 2006 (JP) ..... 2006-147228

(51) Int. Cl.
*H04R 29/00* (2006.01)

(52) U.S. Cl. ..... 381/59; 381/66; 381/92; 379/406.01

(58) Field of Classification Search ..... None
See application file for complete search history.

(56) References Cited

U.S. PATENT DOCUMENTS

| | | | |
|---|---|---|---|
| 4,008,376 | A | 2/1977 | Flanagan et al. |
| 4,554,639 | A | 11/1985 | Baker et al. |
| 5,226,076 | A | 7/1993 | Baumhauer, Jr. et al. |
| 5,335,011 | A | 8/1994 | Addeo et al. |
| 2003/0059061 | A1 | 3/2003 | Tsuji et al. |

(Continued)

FOREIGN PATENT DOCUMENTS

JP 4-217199 A 8/1992

(Continued)

OTHER PUBLICATIONS

International Search Report, issued on Sep. 4, 2007, in corresponding application PCT/JP2007/060639.

(Continued)

*Primary Examiner* — Benjamin Sandvik
*Assistant Examiner* — Leslie Pilar Cruz
(74) *Attorney, Agent, or Firm* — Rossi, Kimms & McDowell LLP

(57) ABSTRACT

A level ratio calculation circuit calculates average signal level data of signal level data corresponding to each sound collection beam signal, and calculates a level ratio between the average signal level data and each of the signal level data. Since a diffraction sound is substantially equal to all the signal level data, a diffraction sound component of the average signal level data also becomes substantially equal. On the other hand, a collection sound from a speaker is specific to the signal level data of the corresponding sound collection beam signal. Therefore, at the level ratio, the portion corresponding to the diffraction sound is flat and a data level becomes high locally in only the portion corresponding to the collection sound. By using this, the sound collection beam signal including the collection sound is detected.

10 Claims, 8 Drawing Sheets

U.S. PATENT DOCUMENTS

| | | | | |
|---|---|---|---|---|
| 2005/0094795 | A1* | 5/2005 | Rambo | 379/202.01 |
| 2006/0104458 | A1 | 5/2006 | Kenoyer et al. | |

FOREIGN PATENT DOCUMENTS

| | | | |
|---|---|---|---|
| JP | 8-505745 | A | 6/1996 |
| JP | 8-298696 | A | 11/1996 |
| JP | 10-293176 | A | 11/1998 |
| JP | 2003-87887 | A | 3/2003 |
| JP | 2005-229422 | A | 8/2005 |

OTHER PUBLICATIONS

European Search Report for corresponding EP 07 744 073, dated May 26, 2011.

Japanese Office Action; Notification of Reason for Refusal, for corresponding JP 2006-147228 dated, Sep. 6, 2011. English translation provided.

* cited by examiner

SOUND EMISSION AND COLLECTION APPARATUS AND CONTROL METHOD OF SOUND EMISSION AND COLLECTION APPARATUS

This application is a U.S. National Phase Application of PCT International Application PCT/JP2007/060639 filed on May 24, 2007 which is based on and claims priority from JP 2006-147228 filed on May 26, 2006, the contents of which is incorporated herein in its entirety by reference.

TECHNICAL FIELD

This invention relates to a sound emission and collection apparatus used in an audio conference etc. conducted between plural points through a network etc., and particularly to a sound emission and collection apparatus in which a microphone and a loudspeaker are placed in a relatively close position, and a control method of the sound emission and collection apparatus.

BACKGROUND ART

Conventionally, a method for installing a sound emission and collection apparatus every point at which an audio conference is conducted and connecting these apparatuses by a network and communicating a sound signal has often been used as a method for conducting an audio conference between remote places. Then, there are many apparatuses in which a loudspeaker for emitting a sound of a mate apparatus side and a microphone for collecting a sound of own apparatus side are simultaneously installed in one cabinet in the sound emission and collection apparatus.

For example, in an audio conferencing apparatus (a sound emission and collection apparatus) of Patent Reference 1, a sound signal input through a network is emitted from a loudspeaker placed in a ceiling surface and a sound signal of each microphone placed in side surfaces using plural different directions as respective front directions is collected and a sound collection signal is sent to the outside through the network.

Patent Reference 1: JP-A-8-298696

DISCLOSURE OF THE INVENTION

Problems that the Invention is to Solve

However, in the apparatus of Patent Reference 1, a microphone is close to a loudspeaker and thereby, a diffraction sound from the loudspeaker is largely included in a sound collection signal of each microphone. Then, when the volume of this diffraction sound is comparatively large and the volume of an utterance sound from a speaker is relatively small, a speaker orientation cannot be accurately detected to accurately collect a sound from the orientation.

Therefore, an object of the invention is to provide a sound emission and collection apparatus capable of detecting a speaker orientation without being influenced by a diffraction sound and surely collecting and outputting a sound from the speaker, and a control method of the sound emission and collection apparatus.

Means for Solving the Problems

A sound emission and collection apparatus of the invention is characterized by comprising sound emission means comprising a loudspeaker, sound collection means comprising plural microphones arranged in a predetermined pattern, sound collection beam signal generation means for generating plural sound collection beam signals having respectively different directivity by performing delay and amplitude processing with respect to a sound collection signal of each of the microphones of the sound collection means, and sound collection beam signal selection means for calculating an energy ratio between energy of each of the sound collection beam signals and an energy average of all the sound collection beam signals at each timing and selecting the sound collection beam signal in which an absolute value level of the energy ratio is a predetermined value or more.

In this configuration, sound collection beam signal selection means calculates an average value of signal energies to all the sound collection beam signals generated by sound collection beam signal generation means. Then, the sound collection beam signal selection means calculates an energy ratio of the signal energy of each of the sound collection beam signals to the average value of signal energies. Here, when an utterance sound is collected from a certain orientation, the signal energy of the sound collection beam signal corresponding to the orientation becomes high and there is no change in the signal energy of the sound collection beam signal which does not correspond to the orientation. Therefore, only the energy ratio of the sound collection beam signal corresponding to the incoming orientation of the utterance sound becomes high. The sound collection beam signal selection means presets a predetermined threshold value with reference to the average value and when a sound collection beam signal having an absolute value level of the signal energy ratio exceeding the threshold value is detected, the sound collection beam signal is selected. Consequently, the sound collection beam signal corresponding to a speaker orientation is selected without being influenced by a diffraction sound made of signal energy substantially equal with respect to each sound collection means.

Further, a sound emission and collection apparatus of the invention is characterized by comprising sound emission means comprising a loudspeaker, sound collection means which comprises plural microphones having directivity in respectively different orientations arranged in a predetermined pattern and uses an output signal from each of the microphones as a sound collection beam signal, and sound collection beam signal selection means for calculating an energy ratio between energy of each of the sound collection beam signals and an energy average of all the sound collection beam signals at each timing and selecting the sound collection beam signal in which an absolute value level of the energy ratio is a predetermined value or more.

In this configuration, directivity is given to each of the microphones and a sound collection beam signal is directly formed from an output of each of the microphones without using sound collection beam signal generation means. Further in such a configuration, a sound collection beam is selected by sound collection beam signal selection means as described above.

Further, a sound emission and collection apparatus of the invention is characterized by comprising sound emission means comprising a loudspeaker for emitting an input sound signal at a sound pressure symmetrical with respect to a predetermined reference plane, sound collection means made of a first microphone group for collecting a sound of one side of the predetermined reference plane and a second microphone group for collecting a sound of the other side, sound collection beam signal generation means for generating each sound collection beam signal of a first sound collection beam signal group obtained by performing delay and amplitude processing to a sound collection signal of the first microphone group and each sound collection beam signal of a second sound collection beam signal group obtained by performing delay and amplitude processing to a sound collection signal of the second microphone group symmetrically with respect to the predetermined reference plane, and sound collection beam signal selection means for calculating an energy ratio between mutual sound collection beam signals symmetrical with respect to the reference plane at each timing and detecting a combination of the sound collection beam signals in which the energy ratio is not within a predetermined reference level range and selecting one sound collection beam signal from two sound collection beam signals constructing the combination by information as to whether the energy ratio is higher or lower than the reference level range.

In this configuration, sound collection beam signal selection means calculates an energy ratio between mutual sound collection beam signals in positions symmetrical with respect to a reference plane. Here, signal energy of a sound collection beam signal corresponding to a speaker orientation and present in the speaker side with respect to the reference plane becomes high and there is little change in energy of a sound collection beam signal symmetrical with respect to this sound collection beam signal. Therefore, an energy ratio by this combination changes. Further, there is little change in signal energy of a sound collection beam signal which does not correspond to the speaker orientation, so that an energy ratio by other combination does not change. Consequently, only the energy ratio of the combination including the sound collection beam signal corresponding to the incoming orientation of an utterance sound becomes high. The sound collection beam signal selection means presets a predetermined threshold value with reference to an average value of the energy ratios of the combination and when a combination of the sound collection beam signals having an absolute value level of the signal energy ratio exceeding the threshold value is detected, the combination is selected. Then, the sound collection beam signal selection means selects any one of the sound collection beam signals by information as to whether the signal energy of the detected combination is higher or lower than the average value. That is, the sound collection beam signal is selected using the fact that a change is made in a direction in which the energy ratio becomes large when the signal energy of the sound collection beam signal used as the reference side is small and a change is made in a direction in which the energy ratio becomes small when the signal energy of the sound collection beam signal used as the reference side is large at the time of calculating the energy ratio.

Further, a sound emission and collection apparatus of the invention is characterized by comprising sound emission means comprising a loudspeaker for emitting an input sound signal at a sound pressure symmetrical with respect to a predetermined reference plane, sound collection means comprising a first microphone group which comprises plural microphones having directivity in respectively different orientations with respect to one side of the predetermined reference plane and uses an output signal from each of the microphones as a sound collection beam signal and a second microphone group which comprises plural microphones having directivity in respectively different orientations with respect to the other side and uses an output signal from each of the microphones as a sound collection beam signal, the sound collection means for setting a sound collection beam signal obtained by the first microphone group and a sound collection beam signal obtained by the second microphone group symmetrically with respect to the reference plane, and sound collection beam signal selection means for calculating an energy ratio between mutual sound collection beam signals symmetrical with respect to the reference plane at each timing and detecting a combination of the sound collection beam signals in which the energy ratio is not within a predetermined reference level range and selecting one sound collection beam signal from two sound collection beam signals constructing the combination by information as to whether the energy ratio is higher or lower than the reference level range.

In this configuration, a sound collection beam signal is directly formed from a microphone output by giving directivity to each of the microphones without using a sound collection beam signal. In this case, a sound collection beam group formed by directivity of microphones of a first microphone group and a sound collection beam group formed by directivity of microphones of a second microphone group are set symmetrically with respect to a reference plane. Consequently, a sound collection beam is selected by sound collection beam signal selection means as described above.

Further, a sound emission and collection apparatus of the invention is characterized in that by the sound collection beam signal selection means, the energy ratio is converted into a decibel unit and a sound collection beam signal is selected based on a value converted into the decibel unit.

In this configuration, a slight change in a signal energy ratio is remarkably indicated by using a decibel unit. Consequently, detection of a combination of sound collection beam signals in symmetrical positions and a sound collection beam signal by the signal energy ratio is performed more accurately.

A control method of a sound emission and collection apparatus of the invention includes a step of generating plural sound collection beam signals having respectively different directivity based on sound collection signals output from plural microphones arranged in a predetermined pattern, a step of calculating an energy ratio between energy of each of the sound collection beam signals and an energy average of all the sound collection beam signals at each timing, and a step of selecting the sound collection beam signal in which an absolute value level of the energy ratio is a predetermined value or more.

A control method of a sound emission and collection apparatus of the invention includes a step of generating plural first sound collection beam signals having respectively different directivity based on sound collection signals output from a first microphone group for collecting a sound of one side of a predetermined reference plane, a step of generating plural second sound collection beam signals having respectively different directivity based on sound collection signals output from a second microphone group for collecting a sound of the other side symmetrically with respect to the predetermined reference plane respectively to the plural first sound collection beam signals, a step of calculating an energy ratio between mutual sound collection beam signals symmetrical with respect to the reference plane at each timing, a step of detecting a combination of the sound collection beam signals in which the energy ratio is not within a predetermined reference level range, and a step of selecting one sound collection beam signal from two sound collection beam signals constructing the combination by information as to whether the energy ratio is higher or lower than the reference level range.

Effect of the Invention

According to the invention, without being influenced by a level of a diffraction sound, an orientation of a sound source such as a speaker can accurately be detected and a sound from the orientation can surely be collected and output.

DESCRIPTION OF REFERENCE NUMERALS AND SIGNS

1 SOUND EMISSION AND COLLECTION APPARATUS
101 CABINET
11 INPUT-OUTPUT CONNECTOR
12 INPUT-OUTPUT I/F
13 SOUND EMISSION DIRECTIVITY CONTROL PART
14 D/A CONVERTER
15 AMPLIFIER FOR SOUND EMISSION
16 AMPLIFIER FOR SOUND COLLECTION
17 A/D CONVERTER
181, 182 SOUND COLLECTION BEAM GENERATION PART
19 SOUND COLLECTION BEAM SELECTION PART
191 BPF
192 FULL-WAVE RECTIFYING CIRCUIT
193 LEVEL DETECTION CIRCUIT
194 LEVEL RATIO CALCULATION CIRCUIT
195 LEVEL COMPARATOR
196 SOUND COLLECTION BEAM SIGNAL SELECTION CIRCUIT
20 ECHO CANCELLATION PART
201 ADAPTIVE FILTER
202. POSTPROCESSOR
SP1~SP3 LOUDSPEAKER
SPA10 LOUDSPEAKER ARRAY
MIC11~MIC17, MIC21~MIC27 MICROPHONE
MA10, MA20 MICROPHONE ARRAY

BEST MODE FOR CARRYING OUT THE INVENTION

A sound emission and collection apparatus according to a first embodiment of the invention will be described with reference to the drawings.

Figure 1A:
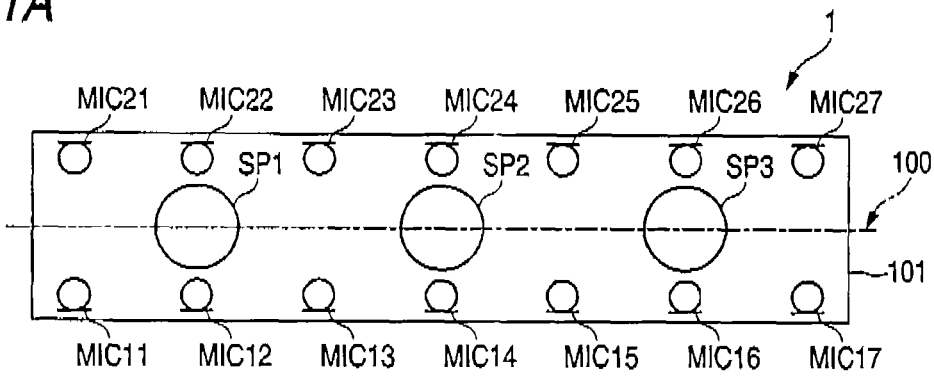
FIG. 1A is a plan diagram showing placement of microphones and loudspeakers of a sound emission and collection apparatus according to the present embodiment.
Figure 1B:
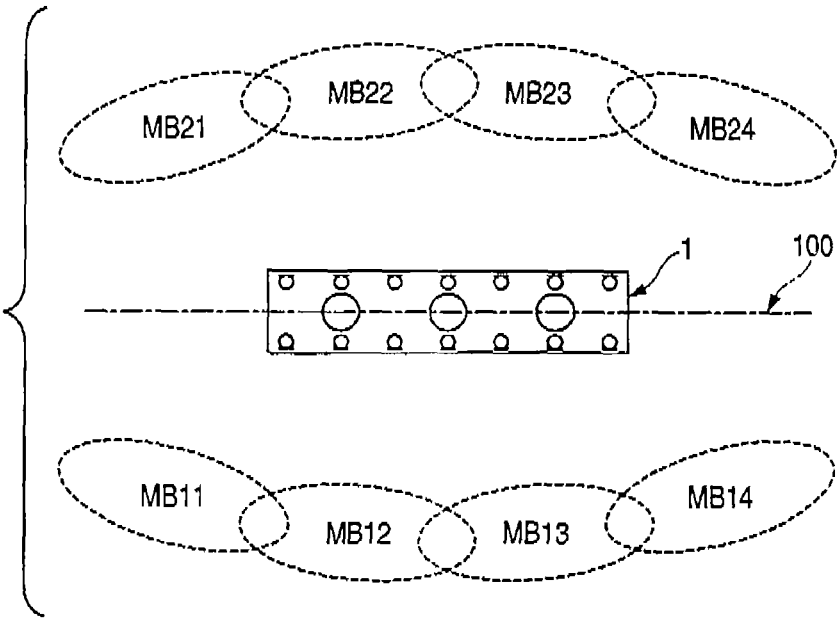
FIG. 1B is a diagram showing a sound collection beam region formed by the sound emission and collection apparatus.

FIG. 1A is a plan diagram showing placement of microphones and loudspeakers of a sound emission and collection apparatus 1 according to the present embodiment, and FIG. 1B is a diagram showing a sound collection beam region formed by the sound emission and collection apparatus 1 shown in FIG. 1A.

Figure 2:
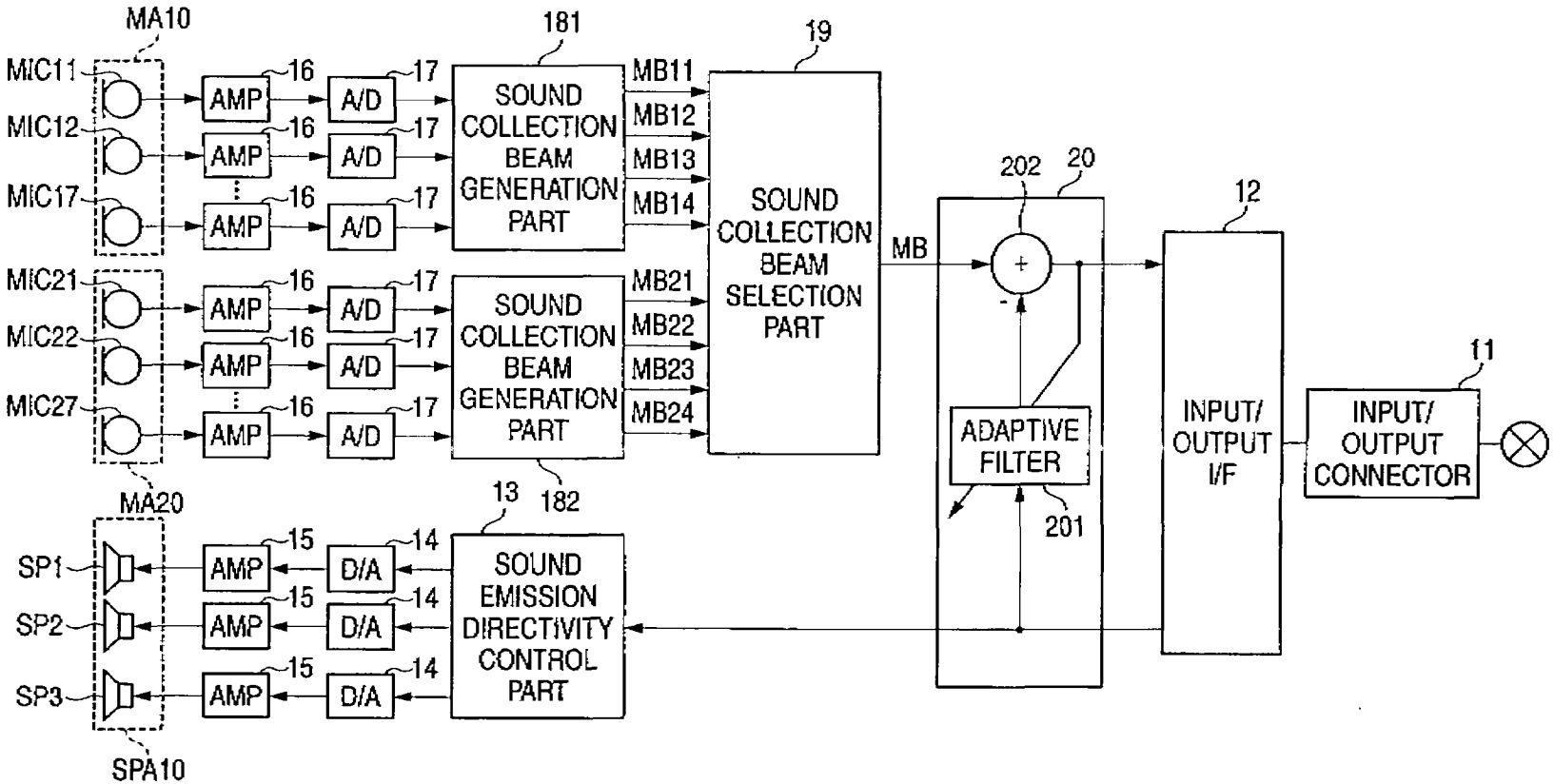
FIG. 2 is a functional block diagram of the sound emission and collection apparatus of the embodiment.

FIG. 2 is a functional block diagram of the sound emission and collection apparatus 1 of the embodiment.

The sound emission and collection apparatus 1 of the embodiment is configured to comprise plural loudspeakers SP1 to SP3, plural microphones MIC11 to MIC17, MIC21 to MIC27 and functional parts shown in FIG. 2 in a cabinet 101.

The cabinet 101 is made of substantially a rectangular parallelepiped shape of a long size in one direction, and leg parts (not shown) with predetermined heights for separating a lower surface of the cabinet 101 from an installation surface at a predetermined distance are installed in both ends of long-sized sides (surfaces) of the cabinet 101. In addition, in the following description, a surface of a long size among four side surfaces of the cabinet 101 is called a long-sized surface and a surface of a short size among the four side surfaces is called a short-sized surface.

Non-directional unit loudspeakers SP1 to SP3 with the same shape are installed in the lower surface of the cabinet 101. These unit loudspeakers SP1 to SP3 are linearly installed along a long-sized direction at a constant distance, and are installed so that a straight line joining the centers of each of the unit loudspeakers SP1 to SP3 extends along the long-sized surface of the cabinet 101 and a horizontal direction position matches with the central axis 100 joining between the centers of the short-sized surfaces. That is, the straight line joining the centers of the loudspeakers SP1 to SP3 is placed in a vertical reference plane including the central axis 100. A loudspeaker array SPA10 is constructed by arranging and placing the unit loudspeakers SP1 to SP3 thus. When a sound is emitted from each of the unit loudspeakers SP1 to SP3 of the loudspeaker array SPA10 in such a state, the emitted sound equally propagates to the two long-sized surfaces. In this case, the emitted sound propagating to the two opposed long-sized surfaces travels in mutually symmetrical directions orthogonal to the reference plane.

Microphones MIC11 to MIC17 with the same specifications are installed in one long-sized surface of the cabinet 101. These microphones MIC11 to MIC17 are linearly installed along the long-sized direction at a constant distance and thereby, a microphone array MA10 is constructed. Further, microphones MIC21 to MIC27 with the same specifications are installed in the other long-sized surface of the cabinet 101. These microphones MIC21 to MIC27 are also linearly installed along the long-sized direction at a constant distance and thereby, a microphone array MA20 is constructed. The microphone array MA10 and the microphone array MA20 are placed so that the vertical positions of the arrangement axes match and further, each of the microphones MIC11 to MIC17 of the microphone array MA10 and each of the microphones MIC21 to MIC27 of the microphone array MA20 are respectively placed in positions symmetrical with respect to the reference plane. Concretely, for example, the microphone MIC11 and the microphone MIC21 have a relation symmetrical with respect to the reference plane and similarly, the microphone MIC17 and the microphone MIC27 have a symmetrical relation.

In addition, in the embodiment, the number of loudspeakers of the loudspeaker array SPA10 is set at 3 and the number of microphones of each of the microphone arrays MA10, MA20 is respectively set at 7, but are not limited to this, and the number of loudspeakers and the number of microphones could be set properly according to specifications. Further, the distance between each of the loudspeakers of the loudspeaker array and the distance between each of the microphones of the microphone array may be not constant and, for example, a form of being closely placed in the center along the long-sized direction and being loosely placed toward both ends may be used.

Next, the sound emission and collection apparatus 1 of the embodiment functionally comprises an input-output connector 11, an input-output I/F 12, a sound emission directivity control part 13, D/A converters 14, amplifiers 15 for sound emission, the loudspeaker array SPA10 (loudspeakers SP1 to SP3), the microphone arrays MA10, MA20 (microphones MIC11 to MIC17, MIC21 to MIC27), amplifiers 16 for sound collection, A/D converters 17, sound collection beam generation parts 181, 182, a sound collection beam selection part 19, and an echo cancellation part 20 as shown in FIG. 2.

The input-output I/F 12 converts an input sound signal from another sound emission and collection apparatus input through the input-output connector 11 from a data format (protocol) corresponding to a network, and gives the sound signal to the sound emission directivity control part 13 through the echo cancellation part 20. Further, the input-output I/F 12 converts an output sound signal generated by the echo cancellation part 20 into a data format (protocol) corresponding to a network, and sends the output sound signal to the network through the input-output connector 11.

When sound emission directivity is not set, the sound emission directivity control part 13 simultaneously gives a sound emission signal based on an input sound signal to each of the loudspeakers SP1 to SP3 of the loudspeaker array SPA10. Further, when sound emission directivity of setting etc. of a virtual point sound source is specified, the sound emission directivity control part 13 generates individual sound emission signals by performing amplitude processing and delay processing, etc. respectively specific to each of the loudspeakers SP1 to SP3 of the loudspeaker array SPA10 with respect to the input sound signals based on the specified sound emission directivity. The sound emission directivity control part 13 outputs these individual sound emission signals to the D/A converters 14 installed every loudspeakers SP1 to SP3. Each of the D/A converters 14 converts the individual sound emission signal into an analog format and outputs the signal to each of the amplifiers 15 for sound emission, and each of the amplifiers 15 for sound emission amplifies the individual sound emission signal and gives the signal to the loudspeakers SP1 to SP3.

The loudspeakers SP1 to SP3 make sound conversion of the given sound emission signals and individual sound emission signals and emit sounds to the outside. The loudspeakers SP1 to SP3 are installed in the lower surface of the cabinet 101, so that the emitted sounds are reflected by an installation surface of a desk on which the sound emission and collection apparatus 1 is installed, and are propagated from the side of the apparatus in which a conference person is present toward the oblique upper portion. Further, apart of the emitted sound is diffracted from a bottom surface of the sound emission and collection apparatus 1 to side surfaces in which the microphone arrays MA10, MA20 are installed.

Each of the microphones MIC11 to MIC17 and MIC21 to MIC27 of the microphone arrays MA10 and MA20 may be non-directional or directional, but it is desirable to be directional, and a sound from the outside of the sound emission and collection apparatus 1 is collected and electrical conversion is made and a sound collection signal is output to each of the amplifiers 16 for sound collection.

In this case, diffraction sounds from the unit loudspeakers SP1 to SP3 of the loudspeaker array SPA10 are equally collected by the microphones MIC1*n* (n=1 to 7) of the microphone array MA10 and the microphones MIC2*n* (n=1 to 7) of the microphone array MA20 which are in positions symmetrical with respect to the reference plane from the configuration of such a loudspeaker array SPA10 and the configuration of the microphone arrays MA10, MA20.

Each of the amplifiers 16 for sound collection amplifies the sound collection signal and respectively gives the signals to the A/D converters 17, and the A/D converters 17 make digital conversion of the sound collection signals and output the signals to the sound collection beam generation parts 181, 182. Sound collection signals in each of the microphones MIC11 to MIC17 of the microphone array MA10 installed in one long-sized surface are input to the sound collection beam generation part 181, and sound collection signals in the microphones MIC21 to MIC27 of the microphone array MA20 installed in the other long-sized surface are input to the sound collection beam generation part 182.

The sound collection beam generation part 181 performs predetermined delay and amplitude processing etc. with respect to the sound collection signals of each of the microphones MIC11 to MIC17 and generates sound collection beam signals MB11 to MB14. In the sound collection beam signals MB11 to MB14, regions with different predetermined widths are respectively set in sound collection beam regions along the long-sized surface in the long-sized surface side in which the microphones MIC11 to MIC17 are installed as shown in FIG. 1(B).

The sound collection beam generation part 182 performs predetermined delay processing etc. with respect to the sound collection signals of each of the microphones MIC21 to MIC27 and generates sound collection beam signals MB21 to MB24. In the sound collection beam signals MB21 to MB24, regions with different predetermined widths are respectively set in sound collection beam regions along the long-sized surface in the long-sized surface side in which the microphones MIC21 to MIC27 are installed as shown in FIG. 1(B).

In this case, the sound collection beam signal MB11 and the sound collection beam signal MB21 are formed as beams symmetrical with respect to a vertical plane (reference plane) having the central axis 100. Similarly, a pair of the sound collection beam signal MB12 and the sound collection beam signal MB22, a pair of the sound collection beam signal MB13 and the sound collection beam signal MB23, and a pair of the sound collection beam signal MB14 and the sound collection beam signal MB24 are formed as beams symmetrical with respect to the reference plane.

The sound collection beam selection part 19 selects a sound collection beam signal in which a speaker sound is mainly collected from the input sound collection beam signals MB11 to MB14, MB21 to MB24, and outputs the beam signal to the echo cancellation part 20 as a sound collection beam signal MB.

Figure 3:
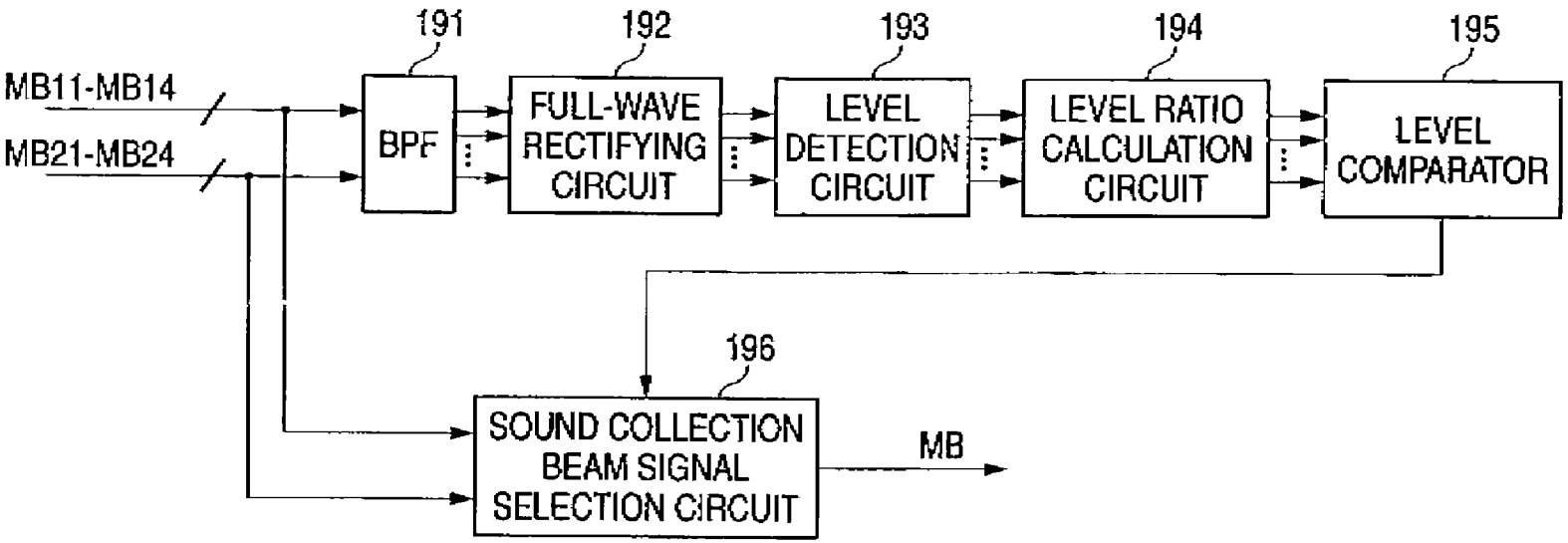
FIG. 3 is a block diagram showing a configuration of a sound collection beam selection part 19 shown in FIG. 2.

FIG. 3 is a block diagram showing a main configuration of the sound collection beam selection part 19.

The sound collection beam selection part 19 comprises a BPF (band-pass filter) 191, a full-wave rectifying circuit 192, a level detection circuit 193, a level ratio calculation circuit 194, a level comparator 195, and a sound collection beam signal selection circuit 196.

The BPF 191 is a band-pass filter using a main component band of person's sound and a band mainly having beam characteristics as a pass band, and performs band-pass filtering of sound collection beam signals MB11 to MB14, MB21 to MB24, and outputs the beam signals to the full-wave rectifying circuit 192.

The full-wave rectifying circuit 192 performs full-wave rectification (absolutization) of the sound collection beam signals MB11 to MB14, MB21 to MB24.

The level detection circuit 193 performs peak detection of the sound collection beam signals MB11 to MB14, MB21 to MB24 in which the full-wave rectification is performed, and uses this peak value as a signal level (signal energy) at its timing, and outputs respective signal level data E11 to E14, E21 to E24 to the level ratio calculation circuit 194.

Figure 4A:
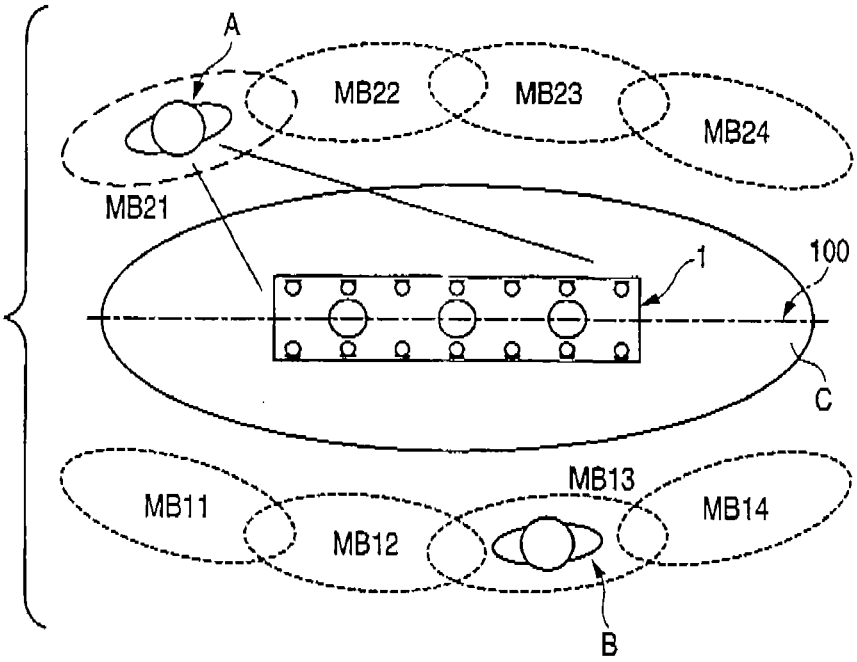
FIG. 4A is a diagram showing a situation in which the sound emission and collection apparatus 1 of the embodiment is placed on a desk C and two conference persons A, B conduct a conference and the conference person A says.
Figure 4B:
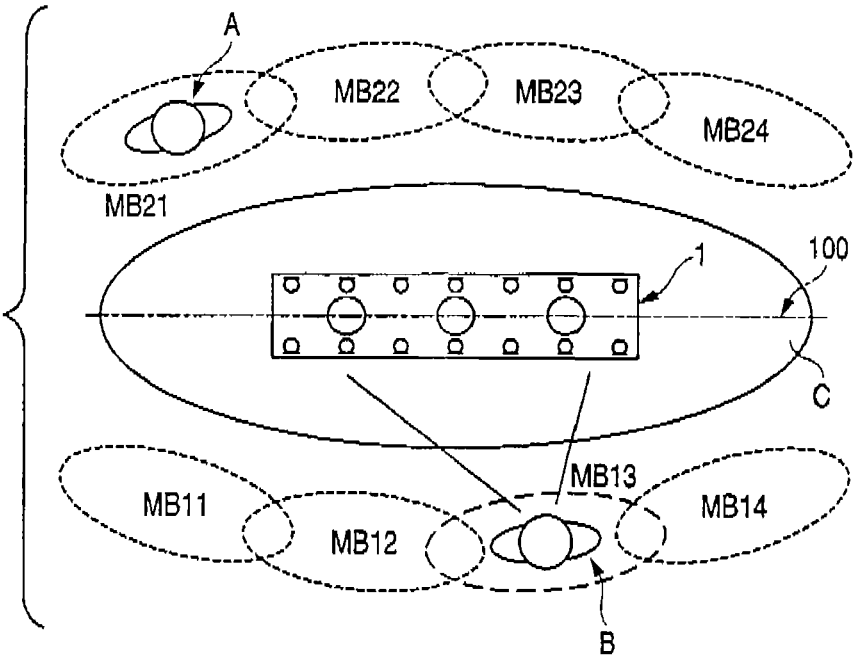
FIG. 4B is a diagram showing a situation in which the sound emission and collection apparatus 1 of the embodiment is placed on the desk C and two conference persons A, B conduct a conference and the conference person B says.
Figure 4C:
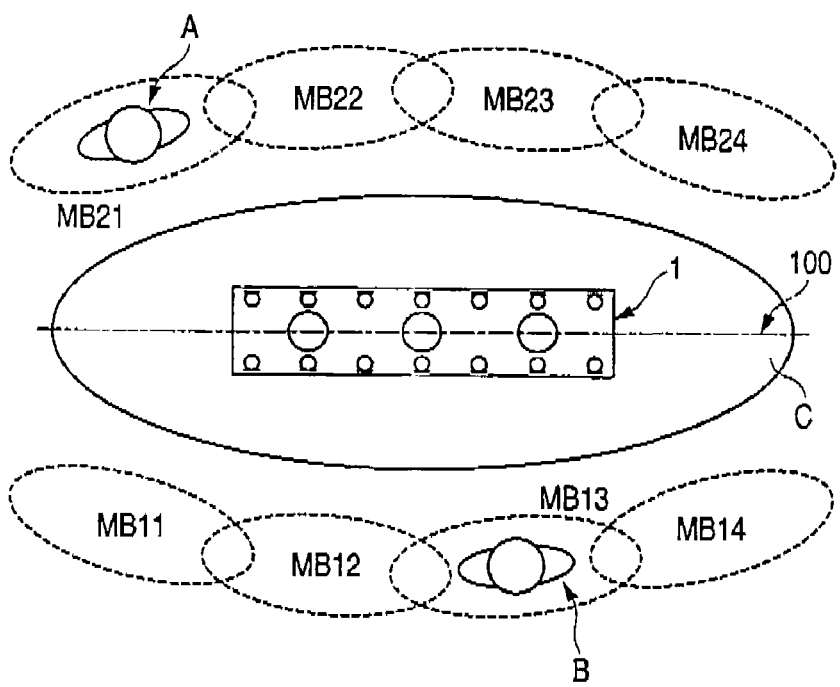
FIG. 4C is a diagram showing a situation in which the sound emission and collection apparatus 1 of the embodiment is placed on the desk C and two conference persons A, B conduct a conference and the conference persons A, B do not say.

Concretely, when a sound is emitted and collected in a situation as shown in FIGS. 4A to 4C and sound emission and utterance of conference persons A, B are generated, each of the signal level data E11 to E14, E21 to E24 is as follows.

FIGS. 4A to 4C are diagrams showing a situation in which the sound emission and collection apparatus 1 of the embodiment is placed on a desk C and two conference persons A, B conduct a conference, and FIG. 4A shows a situation in which the conference person A says, and FIG. 4B shows a situation in which the conference person B says, and FIG. 4C shows a situation in which the conference persons A, B do not say.

Figure 5:
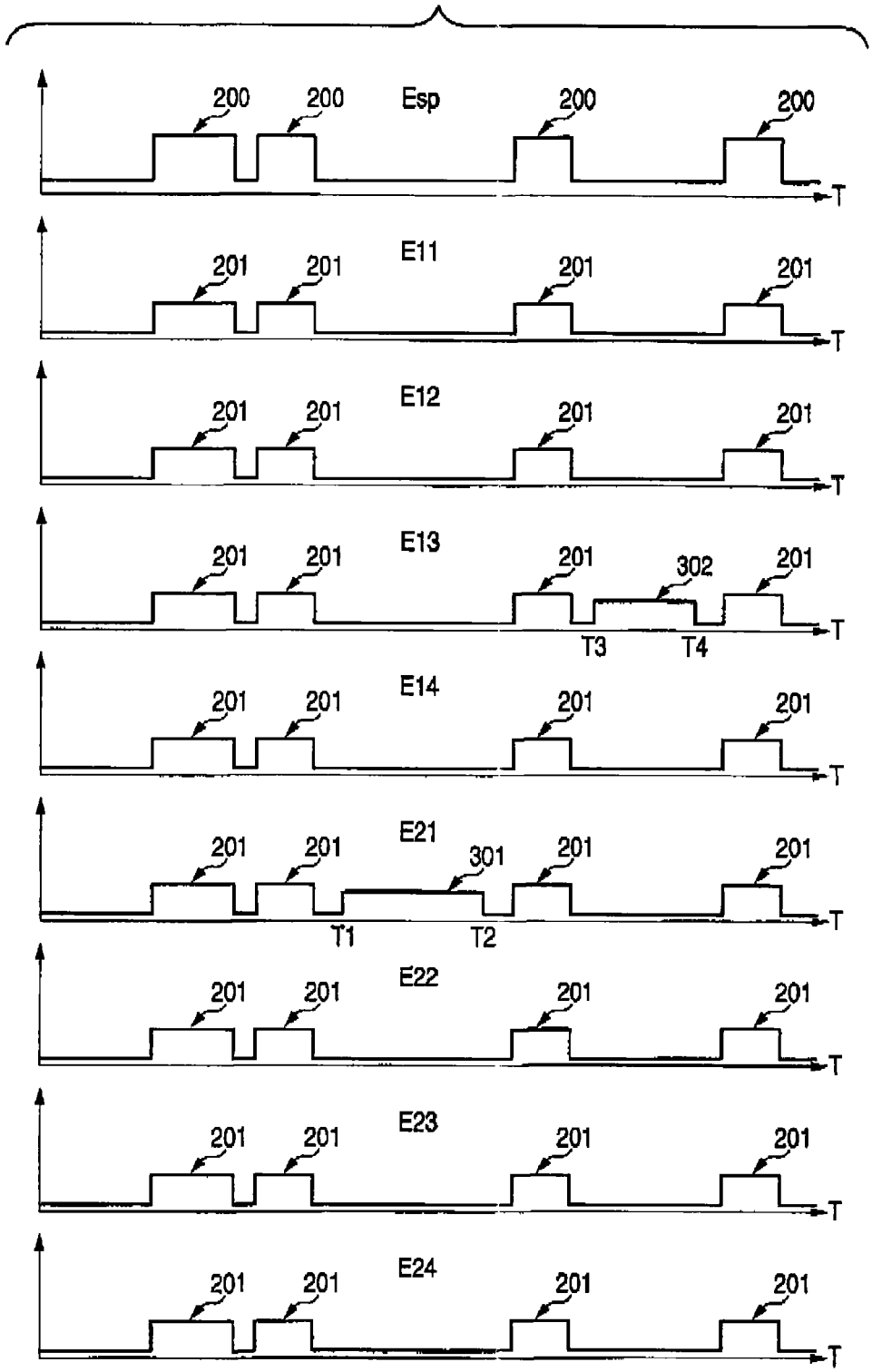
FIG. 5 is a diagram showing time series (T) distribution of signal level data Esp of an emission sound and signal level data E11 to E14, E21 to E24 of each of the sound collection beam signals.

FIG. 5 is a diagram showing time series (T) distribution of signal level data Esp of an emission sound and signal level data E11 to E14, E21 to E24 of each of the sound collection beam signals, and Esp shows the signal level data Esp of the emission sound, and E11 to E14 respectively show the signal level data E11 to E14 corresponding to the sound collection beam signals MB11 to MB14, and E21 to E24 respectively show the signal level data E21 to E24 corresponding to the sound collection beam signals MB21 to MB24. Further, in Esp of FIG. 5, numeral 200 is an emission sound component of an input sound signal and in E11 to E24 of FIG. 5, numeral 201 is a diffraction sound component generated at the time of collecting a diffraction sound. Further, in E11 to E24 of FIG. 5, numeral 301 is a collection sound component generated at the time of collecting an utterance sound of the conference person A and numeral 302 is a collection sound component generated at the time of collecting an utterance sound of the conference person B.

As shown in FIG. 5, when an emission sound is generated, the level detection circuit 193 detects the diffraction sound component 201 as shown in E11 to E24 of FIG. 5 in the signal level data E11 to E14, E21 to E24 of each of the sound collection beam signals MB11 to MB14, MB21 to MB24. Further, when the conference person A says at time T1 to T2 as shown in E21 of FIGS. 4A and 5, the level detection circuit 193 detects the collection sound component 301 in the signal level data E21 of the sound collection beam signal MB21. Further, when the conference person B says at time T3 to T4 as shown in E13 of FIGS. 4B and 5, the level detection circuit 193 detects the collection sound component 302 in the signal level data E13 of the sound collection beam signal MB13.

However, a signal level of the collection sound component 301, 302 may be lower than a signal level of the diffraction sound component 201 as shown in E13, E21 of FIG. 5. In this case, the collection sound component 301, 302 cannot be distinguished from the diffraction sound component 201 and a speaker orientation cannot be detected. In order to solve this, in the invention of the present application, the speaker orientation is detected by calculating a predetermined signal ratio by the following level ratio calculation circuit 194.

The level ratio calculation circuit 194 calculates average signal level data Eav of the signal level data E11 to E14, E21 to E24 input from the level detection circuit 193. Then, the level ratio calculation circuit 194 calculates level ratios CE11 to CE14, CE21 to CE24 between the average signal level data Eav and each of the signal level data E11 to E14, E21 to E24. Concretely, the level ratios CE11 to CE14, CE21 to CE24 are calculated in a decibel unit with respect to each of the signal level data Emn (m=1, 2, n=1 to 4) using the following formula.

$$CEmn = A^{*}\mathrm{Log}(Emn/Eav)(A \text{ is a constant}) \quad (1)$$

Figure 6:
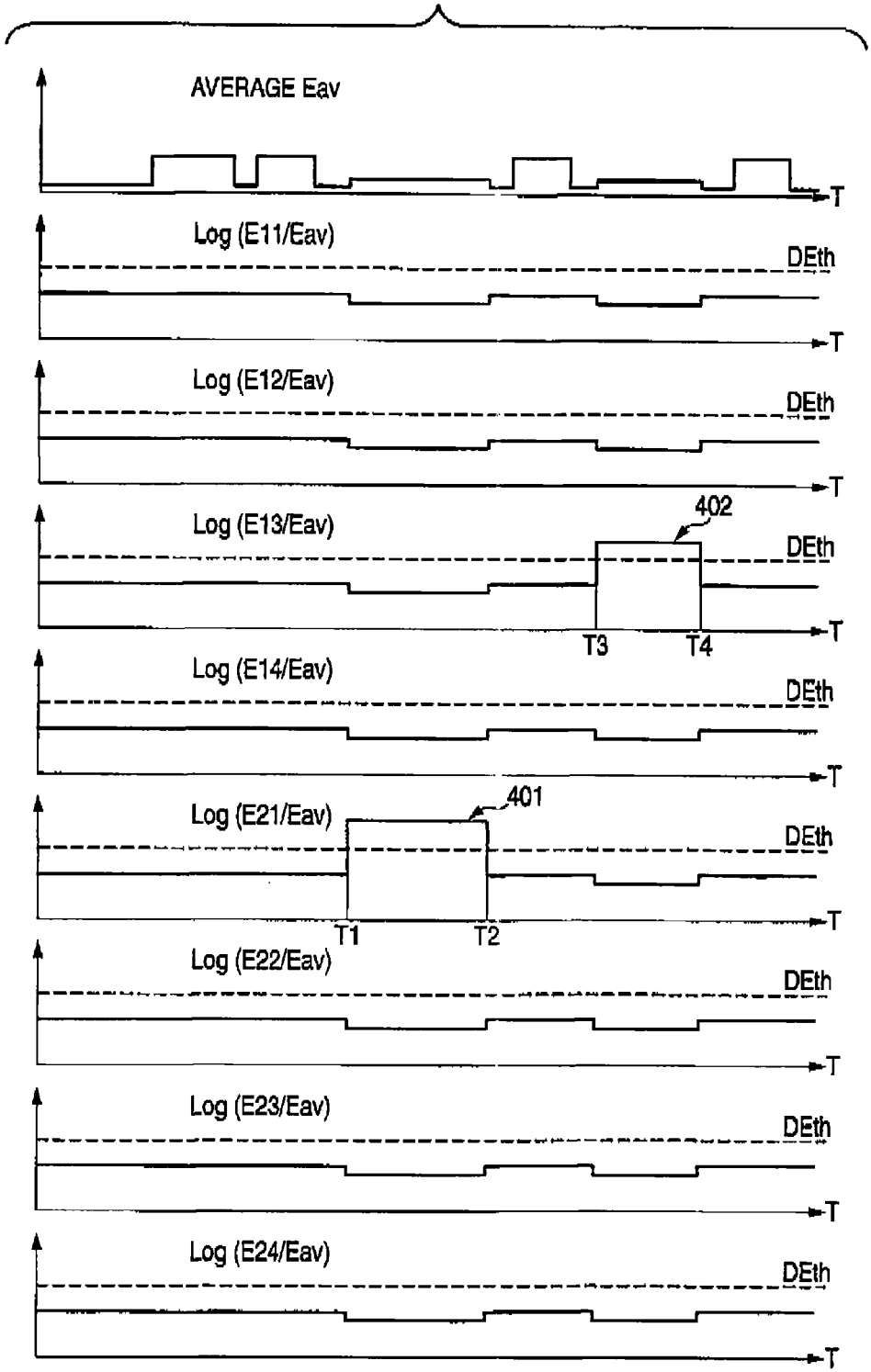
FIG. 6 is a diagram showing time series (T) distribution of average signal level data Eav and level ratios CE11 to CE14, CE21 to CE24.

FIG. 6 is a diagram showing time series (T) distribution of the average signal level data Eav and the level ratios CE11 to CE14, CE21 to CE24, and the average Eav shows the average signal level data Eav, and Log(E11/Eav)-Log(E14/Eav) respectively show level ratio data CE11 to CE14 corresponding to the sound collection beam signals MB11 to MB14, and Log(E21/Eav)-Log(E24/Eav) respectively show level ratio data CE21 to CE24 corresponding to the sound collection beam signals MB21 to MB24.

By dividing each of the signal level data by the average signal level data and calculating the ratio thus, the diffraction sound components 201 substantially equally included in all the signal level data E11 to E14, E21 to E24 become substantially "1", that is, correspond to substantially "0" in the decibel unit. On the other hand, the collection sound component 301 is a component specific to the signal level data E21 and the collection sound component 302 is a component specific to the signal level data E13, so that in the level ratio data CE21, a high level component 401 is generated at timing (T1 to T2) of generation of the collection sound component 301 and in the level ratio data CE13, a high level component 402 is generated at timing (T3 to T4) of generation of the collection sound component 302. In addition, the high level components 401, 402 can be generated more remarkably than the other portion when the constant A is properly set by using the decibel unit thus.

The level ratio calculation circuit 194 outputs these level ratio data CE11 to CE14, CE21 to CE24 to the level comparator 195.

When the level comparator 195 presets a predetermined threshold value DEth with respect to the level ratio data CE and detects data of a level exceeding the threshold value DEth, selection information about the sound collection beam signals MB11 to MB14, MB21 to MB24 corresponding to the corresponding level ratio data CE is output to the sound collection beam signal selection circuit 196. Here, the threshold value DEth is properly preset from a sound collection level etc. of a diffraction sound to an emission sound generated intentionally or background noise in a situation in which there is no collection sound by an utterance sound.

Concretely, in the case of FIG. 6, at a point in time of sampling timing T1 to T2, the high level component 401 is detected and selection information for selecting the sound collection beam signal MB21 corresponding to the level ratio data CE21 is output. Further, at a point in time of sampling timing T3 to T4, the high level component 402 is detected and selection information for selecting the sound collection beam signal MB13 corresponding to the level ratio data CE13 is output.

The sound collection beam signal selection circuit 196 selects a sound collection beam signal corresponding among the sound collection beam signals M11 to MB14, MB21 to M324 based on selection information input from the level comparator 195, and outputs the sound collection beam signal to the echo cancellation part 20 as an output sound collection beam signal MB.

Concretely, in the case of FIG. 6, the sound collection T3 beam signal MB21 is selected and output at a point in time of sampling timing T1 to T2, and the sound collection beam signal MB13 is selected and output at a point in time of sampling timing to T4.

By using such a configuration and processing, even when a sound collection signal level of an utterance sound of a conference person (speaker) is equal to a diffraction sound signal level or becomes lower than the diffraction sound signal level, a sound collection beam signal MB corresponding to the utterance sound can be selected surely.

The echo cancellation part 20 comprises an adaptive filter 201 and a post processor 202. The adaptive filter 201 generates a spurious regression sound signal based on sound collection directivity of the sound collection beam signal MB selected for an input sound signal. The postprocessor 202 subtracts the spurious regression sound signal from the sound collection beam signal MB output from the sound collection beam selection part 19, and outputs the spurious regression sound signal to the input-output I/F 12 as an output sound signal. By performing such echo cancellation processing, the utterance sound can be collected and output at a high S/N ratio.

Next, a sound emission and collection apparatus according to a second embodiment will be described with reference to the drawings.

The sound emission and collection apparatus of the present embodiment differs from that of the first embodiment in only processing of a level ratio calculation circuit 194, a level comparator 195 and a sound collection beam signal selection circuit 196 of a sound collection beam selection part 19 and the other configurations are the same as those of the sound emission and collection apparatus shown in the first embodiment, so that only the processing of the level ratio calculation circuit 194, the level comparator 195 and the sound collection beam signal selection circuit 196 is described and description of the other configurations is omitted.

The level ratio calculation circuit 194 calculates level ratios CE1 to CE4 between mutual signal level data E of sound collection beams symmetrical with respect to the reference plane 100 of FIG. 1 mutually from signal level data E11 to E14, E21 to E24 input from a level detection circuit 193. Concretely, the level ratios CE1 to CE4 are calculated in a decibel unit with respect to each of the signal level data E1*n*, E2*n* (n=1 to 4) using the following formula.

$$CEn=B^{*}\mathrm{Log}(E2n/E1n)(B \text{ is a constant}) \quad (2)$$

FIGS. 7(A) to 7(D) are diagrams showing time series (T) distribution of the level ratios CE1 to CE4, respectively.

By dividing the mutual signal level data in positions symmetrical with respect to the reference plane 100 and calculating the ratio thus, a diffraction sound component 201 of characteristics substantially symmetrical with respect to the reference plane 100 becomes substantially "1", that is, corresponds to substantially "0" in the decibel unit. On the other hand, a collection sound component 301 appears in the signal level data 221 of a sound collection beam signal MB21 corresponding to an orientation of a conference person A and does not appear in a sound collection beam signal MB11 symmetrical to the sound collection beam signal MB21 with respect to the reference plane 100. Therefore, in the level ratio data CE1, a positive direction high level component 501 higher than a reference level 0 dB in a positive direction is generated at timing (T1 to T2) of generation of the collection sound component 301 from the formula (2). Further, a collection sound component 302 appears in the signal level data E13 of a sound collection beam signal MB13 corresponding to an orientation of a conference person B and does not appear in a sound collection beam signal MB23 symmetrical to the sound collection beam signal MB13 with respect to the reference plane 100. Therefore, in the level ratio data CE3, a negative direction high level component 502 lower than the reference level 0 dB, that is, high in a negative direction is generated at timing (T3 to T4) of generation of the collection sound component 302 from the formula (2). In addition, the positive direction high level component 501 and the negative direction high level component 502 can be generated more remarkably than the other portion when the constant B is properly set by using the decibel unit thus.

The level ratio calculation circuit 194 outputs these level ratio data CE1 to CE4 to the level comparator 195.

When the level comparator 195 presets a predetermined level range DWth with respect to the level ratio data CE1 to CE4 and detects data of a level exceeding the level range DWth in the positive direction or the negative direction, a combination of the sound collection beam signals corresponding to the corresponding level ratio data CE is detected and selection information about this combination is output to the sound collection beam signal selection circuit 196. Further, the level comparator 195 outputs positive and negative level information indicating whether the corresponding level ratio data CE has a level high in the positive direction or a level high in the negative direction to the sound collection beam signal selection circuit 196. Here, the level range DWth is also properly preset from a sound collection level etc. of a diffraction sound to an emission sound generated intentionally or background noise in a situation in which there is no collection sound by an utterance sound in a manner similar to the threshold value DEth described above.

Figure 7:
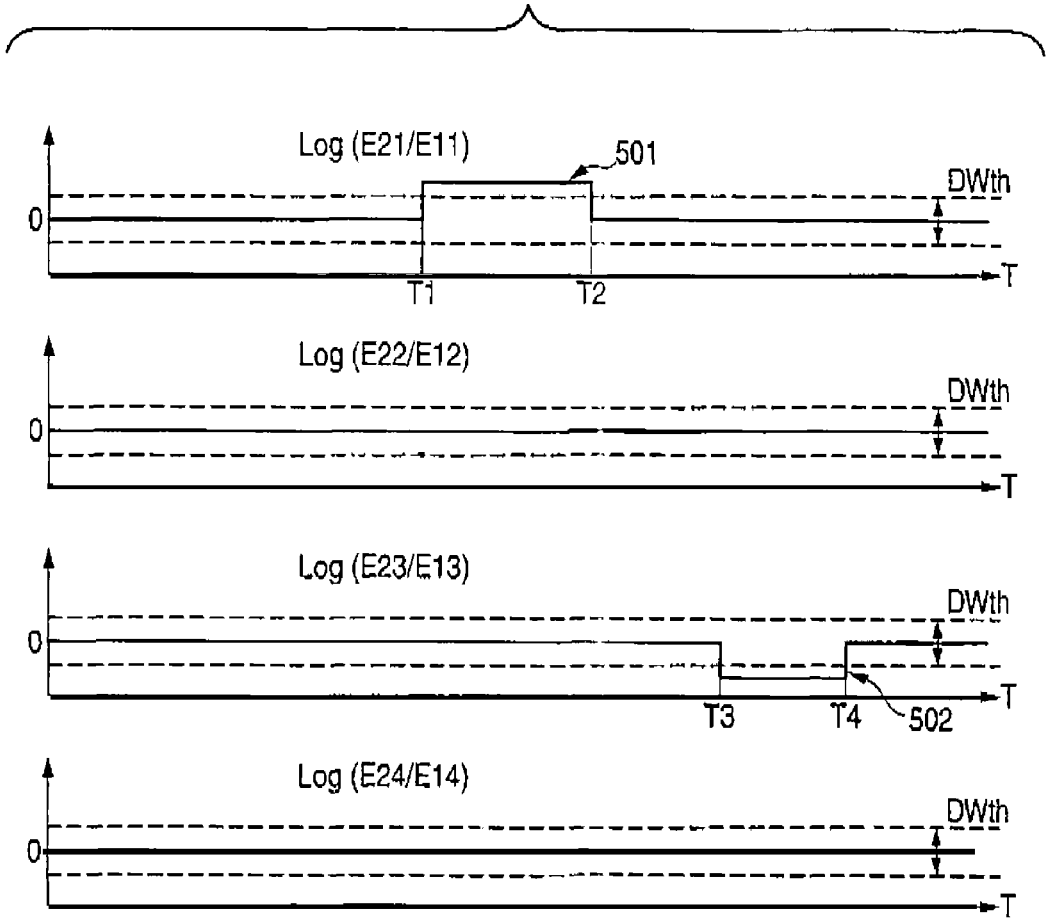
FIG. 7 is a diagram showing time series (T) distribution of level ratios CE1 to CE4, respectively.

Concretely, in the case of FIG. 7, at a point in time of sampling timing T1 to T2, the positive direction high level component 501 is detected and selection information for selecting a combination of the sound collection beam signals MB11, MB21 corresponding to the level ratio data CE1 is output. Further, positive level information indicating that it is a level high in the positive direction is output.

On the other hand, at a point in time of sampling timing T3 to T4, the negative direction high level component 502 is detected and selection information for selecting a combination of the sound collection beam signals MB13, MB23 corresponding to the level ratio data CE3 is output. Further, negative level information indicating that it is a level high in the negative direction is output.

The sound collection beam signal selection circuit 196 selects a combination of sound collection beam signals corresponding among the sound collection beam signals MB11 to MB14, MB21 to M324 based on selection information input from the level comparator 195, and selects a sound collection beam signal with a larger signal level from two sound collection beam signals selected based on positive and negative level information, and outputs the sound collection beam signal to an echo cancellation part 20 as an output sound collection beam signal MB.

Concretely, in the case of FIG. 7, the sound collection beam signals MB11, MB21 are selected at a point in time of sampling timing T1 to T2. Further, the case of becoming a high level in the positive direction in the formula (2) is the case where the signal level data E21 is higher than the signal level data E11, so that the sound collection beam signal MB21 is selected based on positive level information.

On the other hand, the sound collection beam signals MB13, MB23 are selected at a point in time of sampling timing T3 to T4. Further, the case of becoming a high level in the negative direction in the formula (2) is the case where the signal level data E13 is higher than the signal level data E23, so that the sound collection beam signal MB13 is selected based on negative level information.

Further, by using such a configuration and processing, even when a sound collection signal level of an utterance sound of a conference person (speaker) is equal to a diffraction sound signal level or becomes lower than the diffraction sound signal level, a sound collection beam signal MB corresponding to the utterance sound can be selected surely.

Further, in the description mentioned above, the example of placing the microphone array symmetrically with respect to the reference plane parallel to the loudspeaker arrangement direction has been shown, but it can also be applied to the case where a microphone array is present in only one side with respect to the reference plane when a method of the first embodiment is used.

Further, in the description of each of the embodiments mentioned above, the case of generating the sound collection beam signal by the sound collection beam generation part has been shown, but it may be constructed so as to give sound collection directivity to each of the microphones MIC11 to MIC17, MIC21 to MIC27 and use an output signal from each of the microphones MIC11 to MIC17, MIC21 to MIC27 as a sound collection beam signal as it is. In this case, it can also be applied to the second embodiment when the sound collection directivity of the mutual microphones in positions symmetrical with respect to the reference plane 100 is set symmetrically with respect to the reference plane 100.

The invention claimed is:

1. A method of controlling a sound emission and collection apparatus, the method comprising the steps of:

generating plural sound collection beam signals having respectively different directivities based on sound collection signals output from plural microphones arranged in a pattern;

calculating an energy ratio between an energy average of all of the sound collection beam signals having respectively different directivities at each timing; and selecting the sound collection beam signal in which an absolute value level of the energy ratio is at least at a threshold value.

2. A method of controlling a sound emission and collection apparatus, the method comprising the steps of:

generating first sound collection beam signals having respectively different directivities based on sound collection signals output from a first microphone group that collects a sound of one side of a reference plane;

generating second sound collection beam signals having respectively different directivities based on sound collection signals output from a second microphone group that collects a sound of the other side of the reference plane;

calculating an energy ratio between respective two of the first and second sound collection beam signals symmetrical with respect to the reference plane at each timing;

detecting a combination of the respective two of the first and second sound collection beam signals in which the energy ratio is not within a reference level range; and selecting one sound collection beam signal from among the respective two of the first and second sound collection beam signals constructing the combination depending on whether the energy ratio is higher or lower than the reference level range.

3. A sound emission and collection apparatus comprising:

a sound emission unit including a loudspeaker;

a sound collector including plural microphones arranged in a pattern;

a sound collection beam signal generator that generates plural sound collection beam signals having respectively different directivities by performing delay and amplitude processing with respect to a sound collection signal of each of the plural microphones of the sound collector; and a sound collection beam signal selector that:

calculates an energy ratio between an energy average of all of the sound collection beam signals having respectively different directivities and energy of each of the sound collection beam signals at each timing; and selects a sound collection beam signal in which an absolute value level of the energy ratio is at least at a threshold value.

4. The sound emission and collection apparatus according to claim 3, wherein the sound collection beam signal selector converts the energy ratio into a value in a decibel unit and selects a sound collection beam signal based on the value in the decibel unit.

5. A sound emission and collection apparatus comprising:

a sound emission unit including a loudspeaker;

a sound collector, including plural microphones having respectively different directivities and arranged in a pattern, that uses an output signal from each of the microphones as a sound collection beam signal; and a sound collection beam signal selector that:

calculates an energy ratio between an energy average of all of the sound collection beam signals having respectively different directivities and energy of each of the sound collection beam signals at each timing; and selects a sound collection beam signal in which an absolute value level of the energy ratio is at least at a threshold value.

6. The sound emission and collection apparatus according to claim 5, wherein the sound collection beam signal selector converts the energy ratio into a value in a decibel unit and selects a sound collection beam signal based on the value in the decibel unit.

7. A sound emission and collection apparatus comprising:

a sound emission unit including a loudspeaker that emits an input sound signal at a sound pressure symmetrical with respect to a reference plane;

a sound collector including a first microphone group that collects a sound of one side of the reference plane and a second microphone group that collects a sound of the side opposite the one side;

a sound collection beam signal generator that generates each sound collection beam signal of a first sound collection beam signal group obtained by performing delay and amplitude processing to a first sound collection signal of the first microphone group, and generates each sound collection beam signal of a second sound collection beam signal group obtained by performing delay and amplitude processing to a second sound collection signal of the second microphone group, each sound collection beam signal of the first sound collection beam signal group being symmetrical to each sound collection beam signal of the second sound collection beam signal group with respect to the reference plane; and a sound collection beam signal selector that:

calculates an energy ratio between respective two of the first and second sound collection beam signals symmetrical with respect to the reference plane at each timing;

detects a combination of the respective two of the first and second sound collection beam signals in which the energy ratio is not within a reference level range; and selects one sound collection beam signal from the respective two sound collection beam signals constructing the combination depending on whether the energy ratio is higher or lower than the reference level range.

8. The sound emission and collection apparatus according to claim 7, wherein the sound collection beam signal selector converts the energy ratio into a value in a decibel unit and selects a sound collection beam signal based on the value in the decibel unit.

9. A sound emission and collection apparatus comprising:

a sound emission unit including a loudspeaker that emits an input sound signal at a sound pressure symmetrical with respect to a reference plane;

a sound collector that includes:

a first microphone group comprising first microphones having respectively different directivities with respect to one side of the reference plane, wherein the sound collector uses an output signal from each of the first microphones as a first sound collection beam signal; and a second microphone group comprising second microphones having respectively different directivities with respect to the other side, wherein the sound collector uses an output signal from each of the second microphones as a second sound collection beam signal, wherein the sound collector sets the first sound collection beam signal obtained by the first microphone group and the second sound collection beam signal obtained by the second microphone group symmetrically with respect to the reference plane; and a sound collection beam signal selector that:

calculates an energy ratio between respective two of the first and second sound collection beam signals symmetrical with respect to the reference plane at each timing;

detects a combination of the respective two of the first and second sound collection beam signals in which the energy ratio is not within a reference level range; and selects one sound collection beam signal from the respective two of the first and second sound collection beam signals constructing the combination depending on whether the energy ratio is higher or lower than the reference level range.

10. The sound emission and collection apparatus according to claim 9, wherein the sound collection beam signal selector converts the energy ratio into a value in a decibel unit and selects a sound collection beam signal based on the value in the decibel unit.

* * * * *